US005105723A

United States Patent [19]

Kazahaya et al.

[11] Patent Number: 5,105,723

[45] Date of Patent: Apr. 21, 1992

[54] SWASH PLATE TYPE AXIAL PISTON PUMP

[75] Inventors: Yukio Kazahaya; Masakuni Ishikawa, both of Saitama, Japan

[73] Assignee: Zexel Corporation, Tokyo, Japan

[21] Appl. No.: 676,207

[22] Filed: Mar. 27, 1991

[30] Foreign Application Priority Data

Apr. 6, 1990 [JP] Japan ..... 2-90118

[51] Int. Cl.[5] ..... F01B 3/02

[52] U.S. Cl. ..... 91/485; 91/505

[58] Field of Search ..... 91/484, 485, 499, 506, 91/505, 504

[56] References Cited

U.S. PATENT DOCUMENTS

| | | | |
|---|---|---|---|
| 2,967,491 | 1/1961 | Wiggerman | 91/505 |
| 3,253,551 | 5/1966 | Thoma | 91/485 |
| 3,810,715 | 5/1974 | Week et al. | 91/485 X |
| 4,520,712 | 6/1985 | Hovorka et al. | 91/499 X |

FOREIGN PATENT DOCUMENTS

| | | | |
|---|---|---|---|
| 63-50681 | 3/1988 | Japan . | |
| 864286 | 3/1961 | United Kingdom | 91/499 |

*Primary Examiner*—Leonard E. Smith
*Attorney, Agent, or Firm*—Nields & Lemack

[57] ABSTRACT

A swash plate type axial piston pump having a valve plate along which a cylinder block slides. The valve plate has an intake port and a discharge port, respectively positioned on a small pitch circle. Oil passages are slanted extending from the intake port and the discharge port to a cylinder hole of the cylinder block of the piston pump, converging at an axial centerline of the cylinder block. Being different from the slanted oil passage, oil guide holes are formed extending from a bottom of the cylinder hole in parallel with a rotary shaft. Supplying pressed oil to the oil guide hole enables to decrease a pressure between the cylinder block and the valve plate.

5 Claims, 7 Drawing Sheets

Fig. 3
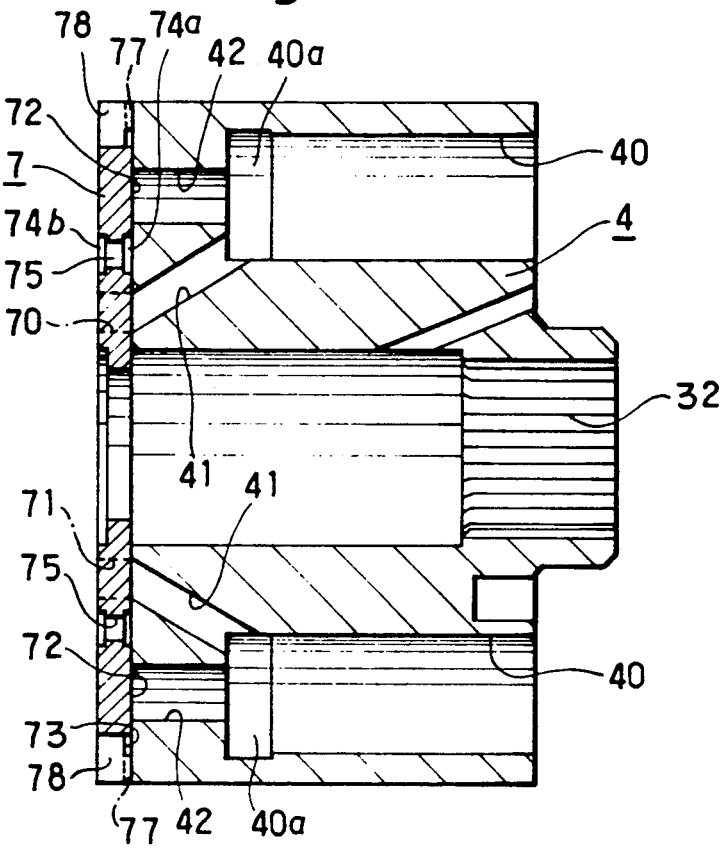
Fig. 4-B
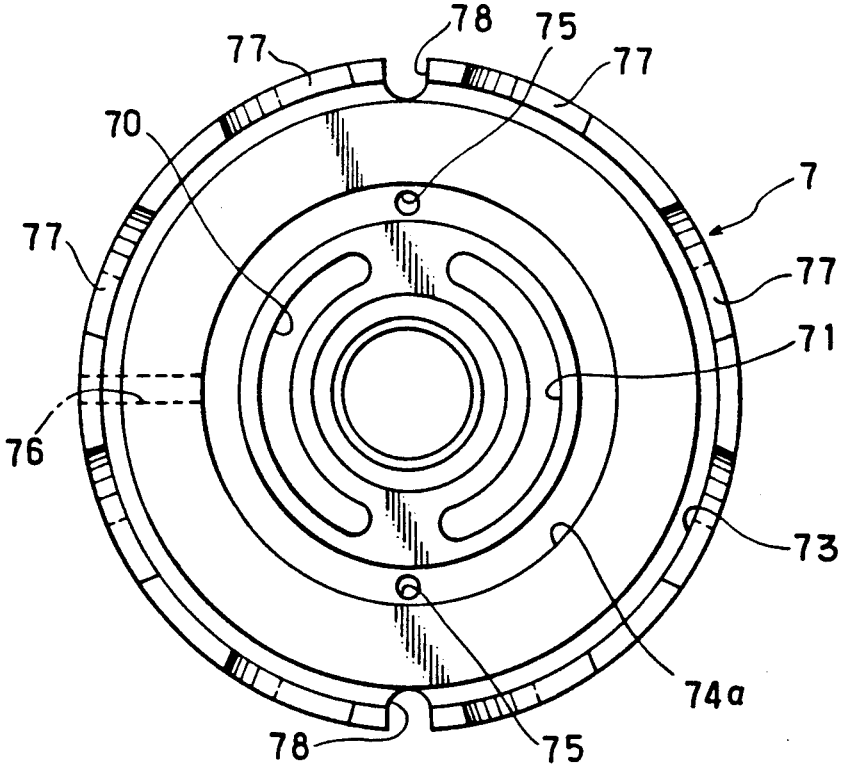

Fig. 4-A

SWASH PLATE TYPE AXIAL PISTON PUMP

FIELD OF THE INVENTION

The present invention relates to a swash plate type axial piston pump.

BACKGROUND OF THE INVENTION

An axial piston pump of a type having a swash plate and a rotable cylinder block is known. An axial piston pump of the kind of a variable displacement which is carried out by changing an angle of the swash plate is shown in Japan Patent Application Laid-open No. 50681/1988.

According to the axial piston pump above, an integral rotation of the cylinder block and a rotary shaft makes a longitudinal stroke of a piston due to an existence of a swash plate and, resultantly, an end face of the cylinder block, which face being situated on the opposite side of a space in which a swash plate is placed, slides on a valve plate placed on a side of a cover. The valve plate has a pair of intake port and discharge port, respectively formed therein and they are placed oppositely along the diameter. When the piston moves or slides in the cylinder, liquid for example oil contained in the cylinder is intaken or discharged. The strokes of the piston are repeatedly carried out in the cylinder.

According to the conventional axial piston pump above, a pitch circle of the intake port and the discharge port (which circle is an imaginary one passing through these semicircular shape ports) is made large and accordingly such ports are placed on the circumference of the large pitch circle. It is apparent that the intake port and discharge port are formed in the cylinder block surface so as to extend in parallel with the piston.

Consequently, when the cylinder block rotates at a high speed, the intake port and the discharge port rotate at a high circumferential speed, so that an intake efficiency for liquid deteriorates and lowers and additionally disadvantageous vibration and noise are generated.

In order to solve the disadvantageous problem of the conventional axial piston pump, as shown in FIGS. 5 and 6, openings 80 of intaking and discharging, respectively connected to the cylinders are provided slantly so as to extend from ends of the cylinders toward the axis of the cylinder block 8. As a result, an intake port 700 and a discharge port 710 are placed near the central axis of the valve plate *7a*.

However, according to the conventional construction of the pump, a diameter or an area of the pressure-receiving face of the valve plate *7a* is small and a unit pressure applied to the valve plate *7a* and the cylinder block 8. As a result, a sliding friction between the cylinder block 8 and the valve plate *7a* increases, shortening the life time of the valve plate. In addition, a point of application of a pressing force F on the cylinder block 8 and another point of application of a reaction force $F_1$ on the valve plate *7a* are shifted, so a moment of force M shown in FIG. 5 is generated, resulting in a separation of the cylinder block 8 from the valve plate *7a*, in particular, at a position C shown in FIG. 5 and in an increase of disadvantageous liquid leakage. It is possible to increase the diameter of the valve plate *7a* to that of the cylinder block in order to solve the problem. Consequently, the circumferential speed of the large valve plate increases. Due to the composite effect of the moment of force M and the increased circumferential speed, it is apt to generate a burring or a seizure at a region or portions of an end of the valve plate and an outer edge of the cylinder block.

SUMMARY OF THE INVENTION

Accordingly, it is a purpose of the present invention to provide a swash plate type axial piston pump enabling to attain simultaneously an improvement in the suction performance of the pump and a decrease in face pressure between the cylinder block and the valve plate with a simple construction of the related portion of the pump.

In order to attain the purpose above, in the pump of a type having a cylindrical casing, a cylinder block having a plurality of cylinder holes arranged along the circumference so as to direct in the axial direction of the casing, the cylinder block being arranged within the casing so as to rotate together with a rotary shaft, a plurality of pistons each slidably fits in respective cylinders of the cylinder block so as to extend its end from the cylinder hole, being pressed on a slant angle controllable swash plate, a cover provided with an intake opening and a discharge opening and secured integrally to a portion of the casing on the opposite side of the swash plate, and a valve plate positioned stationaly opposed to an end face of the cylinder block on the opposite side of the swash plate, the valve plate has an intake port and a discharge port, respectively of an arc-shaped, these ports being arranged symmetrically around its center, the cylinder block has a pair of slanted oil passages extending from a bottom corner of each cylinder interior or hole to the intake port and the discharge port, and each cylinder interior has oil guide orifices or holes for leading pressed oil in the cylinder interior toward a part of the valve plate positioned at a side of the circumference outer than the intake port and the discharge port, which guide hole being formed to extend in parallel with the rotary shaft.

According to the particular construction of the axial pump, the piston always comes to contact with the swash plate, so rotations of the cylinder block carry out longitudinal strokes of the piston. During a stroke in which the space of the cylinder interior increases, oil is sucked from the intake port of the valve plate through the slanted oil passage. On the contrary, while another stroke in which the space decreases, oil is pressed becoming high pressure oil and being discharged from the slanted oil passage to the discharge port. During the discharging of oil, high pressure oil is also sent from the oil guide orifice, formed in parallel with the rotary shaft, toward a static pressure face of the valve plate.

Due to the particular relation between the slanted oil passage slanted toward the axis of the cylinder block and a small pitch circle, the circumferential speed of the cylinder block fails to become of high even though the cylinder block rotates at a high speed and oil sucking efficiency becomes good. Additionally, because a pressure receiving face of the valve plate is large, a unit pressure on the face decreases. It is convenient that pressure oil is applied to an area near the outer circumference of the valve plate through the oil guide orifices. Accordingly, pressing force effected between the valve plate and the cylinder block decreases, thereby oil membrane is effectively formed between them. As a result, little sliding abrasion is occurred between the cylinder block and the valve plate, prolonging their life times. Owing to decreased friction resistance between the cylinder block and the valve plate, preferably torque efficiency rises.

In general, the valve plate is manufactured separately from the cylinder block and the casing cover. It is possible if necessary to make the valve plate integrally on a front end of the cover.

Other features and merits of the present invention will be made apparent from the following description using its embodiments. While the embodiments of the present invention, as herein disclosed, constitute preferred forms, it is to be understood that other forms or modifications might be adopted.

BRIEF DESCRIPTION OF THE DRAWING

FIG. 3 is a section showing an arrangement of the cylinder block and the valve plate, respectively of the axial pump according to the present invention.

FIG. 4-B is another end view of the valve plate seen from the side of the cylinder block.

DETAILED DESCRIPTION OF THE PREFERRED EMBODIMENT

Figure 4:
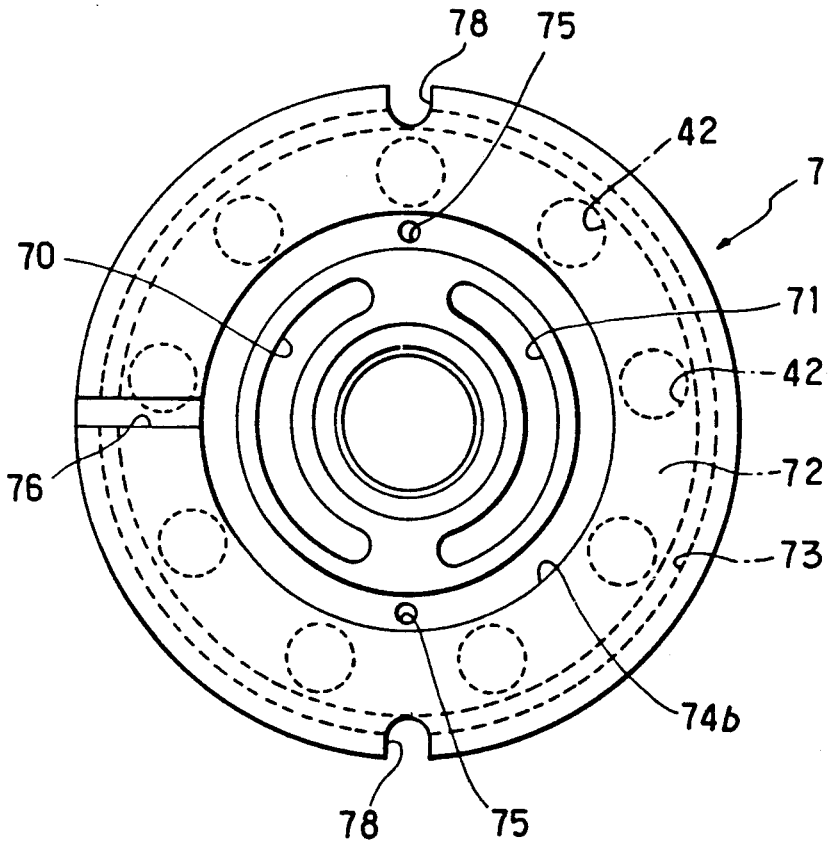
FIG. 4-A shows an end view seeing the valve plate from the side of the casing cover.

Respective embodiments of the axial pump according to the present invention will be explained with reference to the accompanying drawings, of which FIG. 1 to FIG. 4-A and FIG. 4-B depicting an embodiment of the swash plate type changeable displacement axial pump according to the present invention.

Figure 1:
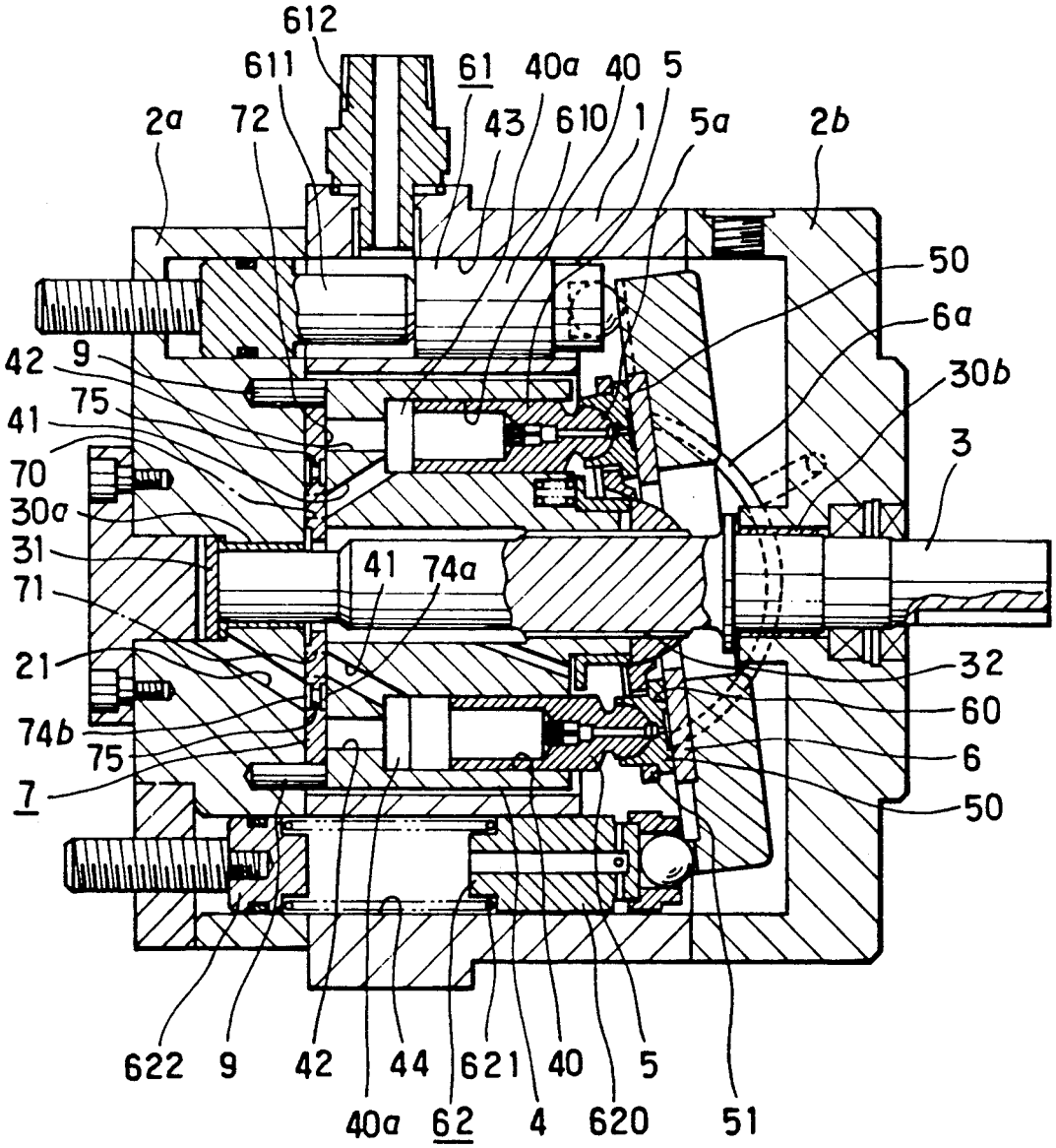
FIG. 1 is a longitudinal section of a first embodiment of a swash plate variable displacement type axial pump according to the present invention.
Figure 2:
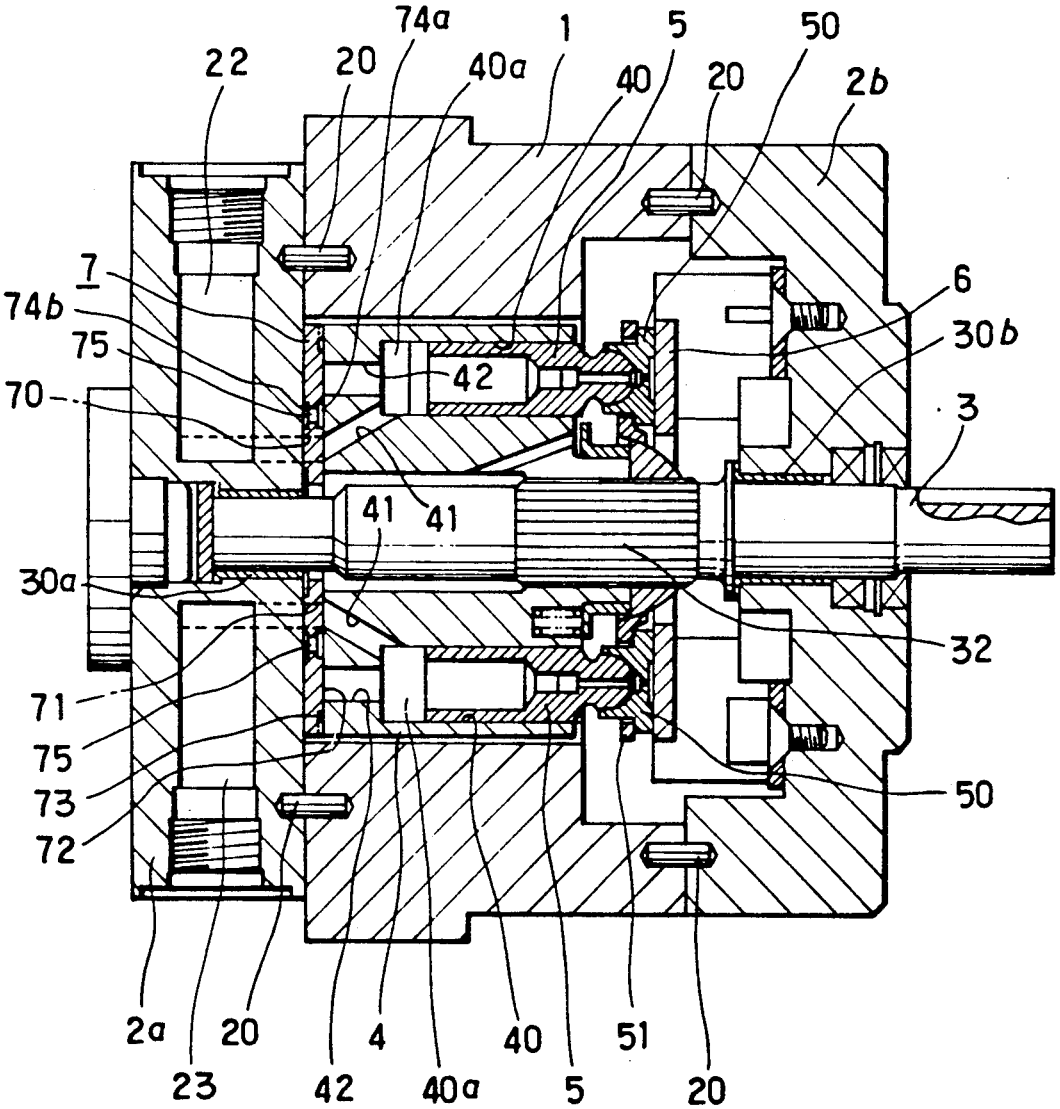
FIG. 2 is a cross sectional view of the first embodiment shown in FIG. 1.

In FIGS. 1 and 2, the reference numeral 1 is a cylindrical casing provided with a front cover 2*a* and a rear cover 2*b*. These covers 2*a* and 2*b* are fixed to the casing 1 by means of pegs 20.

A rotary shaft 3 fits into holes at the centers of these covers 2*a* and 2*b* and journalled rotatably through a pair of radial bearings 30*a*, 30*b* situated in the covers 2*a* and 2*b*. The rotary shaft 3 is lubricatly supported by a thrust bearing 31 provided in the front cover 2*a*.

A cylinder block 4 is placed within the casing 1. This cylinder block 4 is aligned with the rotary shaft 3 and has a central hole in which the rotary shaft 3 fits. A spline 32 formed on the rear half portion of the central hole fits in another spline formed on the rotary shaft 3, thereby the cylinder block rotates together with the rotary shaft 3.

The cylinder block 4 has a plurality of cylinder holes 40 (nine of the number in the embodiment) formed in the block 4 so as to be in parallel with the rotary shaft 3. Each cylinder hole 40 opens by its rear end and a piston 5 is slidably placed in these cylinder hole 40.

These pistons 5 have shoes 50 attached thereto through a ball joint 5*a* formed at an end of the piston 5. These shoes 50 are pressed to a slanted sliding face 60 of the swash plate 6 by a pressing plate 51. The swash plate 6 is supported by the cover 2*b* through a ball bearing 6*a* formed at a rear of the swash plate 6.

In addition, as shown in FIG. 1, the swash plate 6 is held in a manner of slant-changeable by means of at least a hydraulic cylinder mechanism 61 formed on the cylindrical casing 1 and a bias mechanism 62 placed at a position opposed diametrically or displaced by 180 degree around the circumference. In consequence, it is possible to change the stroke distance of the piston 5, changing the volume of displacement.

Figure 7:
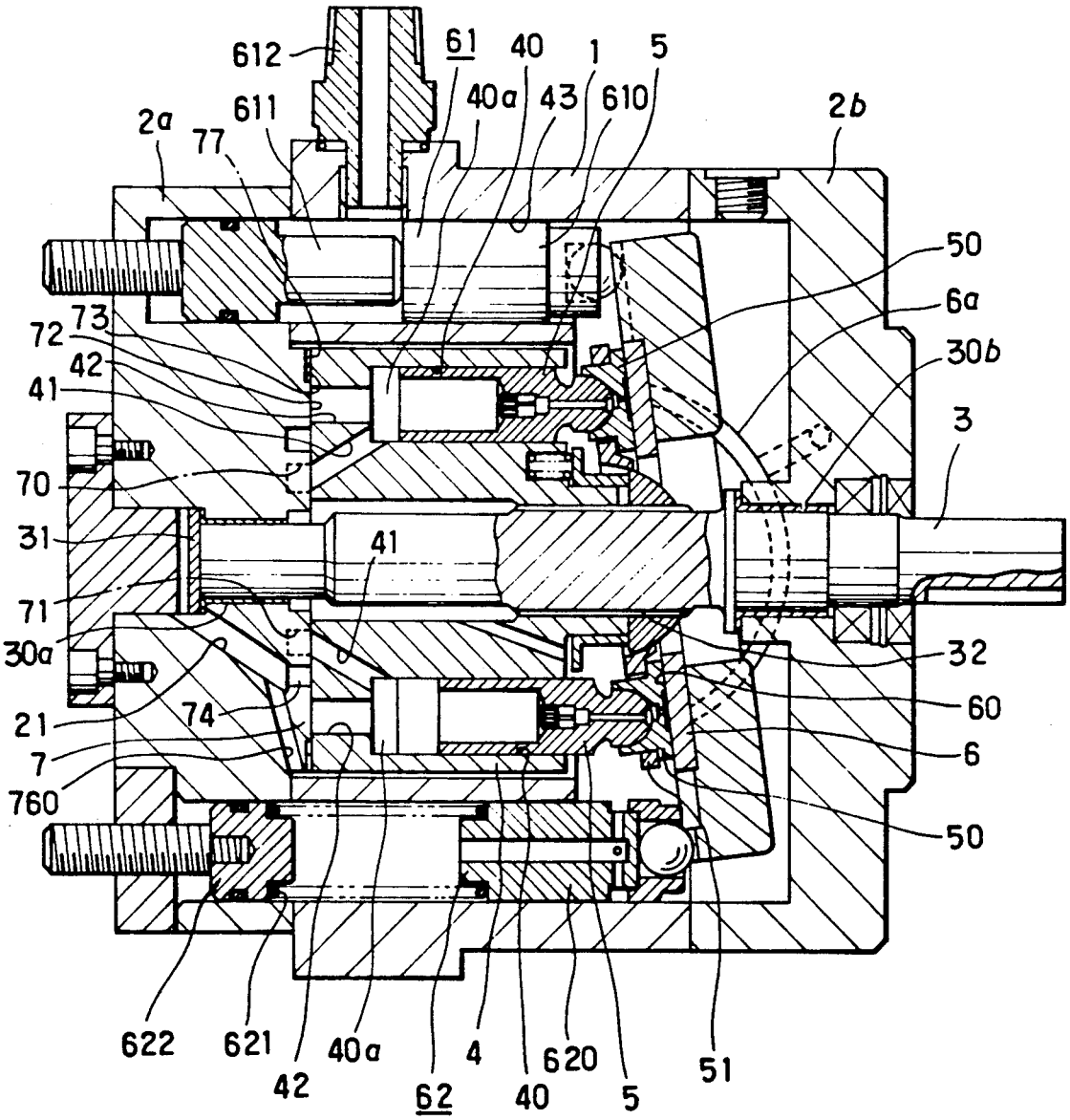
FIG. 7 is a longitudinal section showing another embodiment of the axial pump according to the present invention.

The hydraulic cylinder mechanism 61 has as shown in FIG. 7 a through hole 43 formed in the casing 1, a pressing piston 610 slidably fitted in the through hole 43 and having an end ball adapted to come in contact with the swash plate, a threaded stopper 611 limitting its retreat movement of the pressing piston 610, and a supply means 612 for supplying oil pressure to a pressing chamber at a rear of the pressing piston 610.

It is apparent that the bias mechanism 62 consists of another through hole 44 formed in the casing 1, another pressure piston 620 slidably fitted in the through hole 44 and being provided with another end ball adapted to come in contact with the swash plate, a spring 621 for pressing the piston 620 through its rear portion, and a spring force control means 622 for supporting another end of the spring 621. The displacement generating means of the swash plate 6 is not limitted to the embodiment above.

The valve plate 7 coming in contact with an rear end face of the cylinder block 4 has the same diameter as that of the cylinder block 4. According to the embodiment, the valve plate 7 is manufactured independently from the cover 2*a* and placed between a rear face of the cylinder block 4 and an inner face of the cover 2*a*.

The valve plate 7 has at least two notches 78 and 78, and these notches are fixed and stopped from rotating by inserting pins 9 into the notches 78 and pin holes formed in the cover 2*a*. It is possible alternately to secure the valve plate 7 by welding and bonding.

The cylinder block 4 has a piston chamber 40*a* formed in a bottom region of the cylinder hole 40. Slanted oil passages 41 are formed extending from the bottom corner of the piston chamber 40*a*, in particular, the part of the bottom corner near the rotary shaft toward the rotary shaft 3. All slanted oil passages 41 have the same angle and open at the rear ends of the cylinder block.

While, the valve plate 7 has an intake port 70 and a discharge port 71 arranged along a pair of arcs having a small pitch circle so as to match with these openings of the slanted oil passages 41 at the positions near the center of the valve plate 7. These intake port 70 and the discharge port 71 are arranged opposedly and diametrically. As shown in FIG. 2, the intake port 70 is always communicated to the intake port 22 formed in the cover 2*a* through a longitudinal hole the discharge port 71 is always communicated to the discharge port 23 formed in the cover 2*a*.

In more detail, according to the present invention, oil guide holes or orifices 42 extend from the bottoms of the piston chambers 40*a* in parallel with the rotary shaft 3. The oil guide hole or orifice 42 is apparently aligned with the piston chamber 40*a* and has its diameter smaller than that of the cylinder hole. An end of the oil guide orifice or hole 42 opens at a rear end face of the cylinder block 4. According to the embodiment, the interior of the oil guide hole or orifice 42 has a straight wall, but it is possible to have a tapered hole.

A portion of the valve plate 7 confronting to the opening of the oil guide hole 42 is a static pressure receiving face 72 of a flat ring shape. As shown in FIG. 4-B, the valve plate 7 has a ring-like low pressure groove 73 formed in the inner face (contacting with the confronting face of the cylinder block) of the valve plate 7. On an outer face (contacting with the cover 2*a*) and the inner face of the valve plate 7, there are shallow ring-like low pressure grooves 74*a* and 74*b*, respectively arranged on the positions outer than that of the intake port 70 and the discharge port 71 and inner than that of the static pressure receiving face 72 in the diametrical direction.

These shallow ring-like low pressure grooves 74*a* and 74*b*, respectively formed on both faces of the valve plate 7 are communicated to each other by a plurality of longitudinal-directed holes 75 formed in these grooves 74*a* and 74*b*. As shown in FIG. 1, the ring-like low pressure groove 74*b* on the outer face is always communicated with a space or zone containing a thrust bearing 31 by means of at least one guide hole 21 formed in the cover 2*a*. While, as shown in FIG. 4-A, the ring-like low pressure groove 74*a* formed on the outer face is led to out of the outer diameter of the valve body through at least one diametric groove 76. On the inner face of the valve body, there are a plurality of dent-like scallops positioned in a zone diametrically outside of the outer ring-like low pressure groove 73 at a regular interval.

Figure 8:
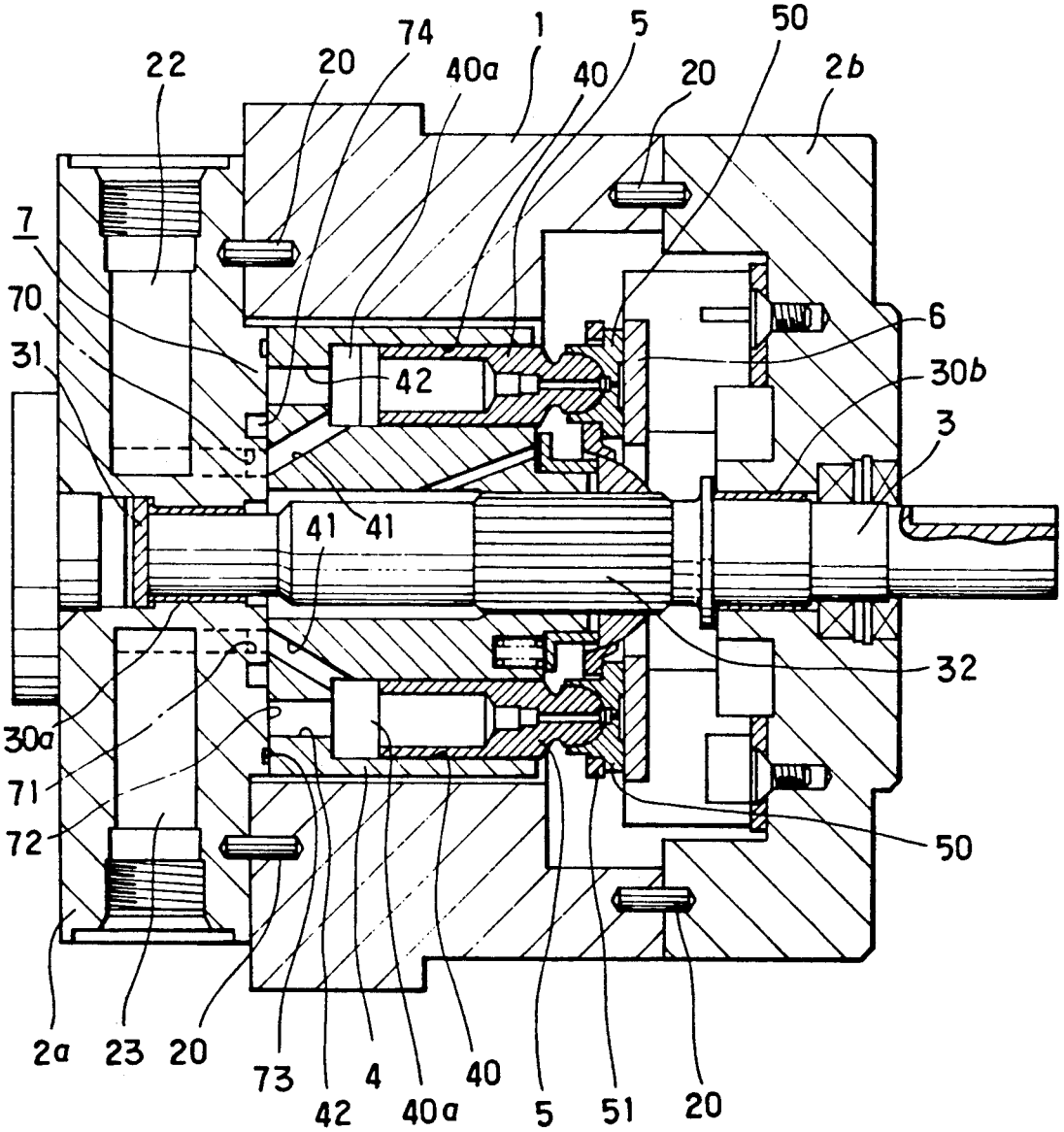
FIG. 8 is a cross section of another or second embodiment.

According to another or second embodiment of the present invention shown in FIGS. 7 and 8, the valve plate 7 is integrally formed on the inner face of the cover 2*a* in a shape of protruded or uneven faced disc. A ring-like dent-shaped low pressure groove 74 is formed on a face of the valve body 7 to which face the cylinder block 4 confronts at the same positions as that of the ring-like low pressure groove 74*a*. At least one guide hole 21 is formed and extends from the bottom of the ring-like low pressure groove 74 toward the thrust bearing 31.

There are static pressure receiving faces 72 formed at the positions of the cover 2*a* more diametric outside of the ring-like low pressure grooves 74, and there are other ring-like low pressure grooves 73 formed at the positions further more outside of the static pressure receiving faces 72. The scallop 77 is situated at the outer periphery of the cover 2*a*. According to the embodiment above, there is no inner face of the valve body 7, so any diametric groove is not formed. Alternately, as shown in FIG. 7, a diametric hole 760 is formed extending from the guide hole 21 to the outside face of the valve body formed on the cover 2*a*.

The construction of the second embodiment according to the present invention other than that described above is the same as that of the first embodiment, so an overlapping explanation has been omitted.

Operation

When the rotary shaft 3 is driven by a motor or the like means, the cylinder block 4 engaging with a spline formed rotates together with the shaft 3. Because that the shoe 50 is pressed onto the swash plate 6 by means of a pressing plate 51, the pistons 5 slidably fitted into the cylinder hole 40 slide along a longitudinal direction within the cylinder hole 40 with their stroke lengths determined according to the slanting angle of the swash plate 6 by rotations of the cylinder block 4.

According to the first embodiment of the present invention shown in FIGS. 1–4, since the valve plate 7 is fixed on the inner face of the cover 2*a*, the cylinder block 4 slides on the valve plate 7. In the stroke of the piston 5 protruding from the cylinder hole 40, oil under a low pressure is sucked from the intake opening 22 to the piston chamber 40*a* through the intake port 70 and the slanted oil passage 41. In another stroke of the piston 5 entering into the cylinder hole 40, oil is pressed and discharged from the slanted oil passage 41 to the discharge opening 23 through the discharge port 71.

According to the present invention, both the intake and the discharge ports 70 and 71, respectively are placed near the center of the cylinder block 4, so resultantly a pitch circle passing both ports are small. Accordingly, even when the cylinder block 4 rotates at a high speed, a circumferential speed of the cylinder block 4 downs improving its sucking performance. In addition, since the outside diameter of the valve plate 7 has substantially the same side as that of the cylinder block 4 and has a large pressure receiving area, a unit pressure on the valve plate 7 is made considerably small. And, the oil guide hole 42 extending from the bottom of the piston chamber 40*a* in parallel with the rotary shaft opens in the static pressure receiving face 72 of the valve plate 7.

Figure 5:
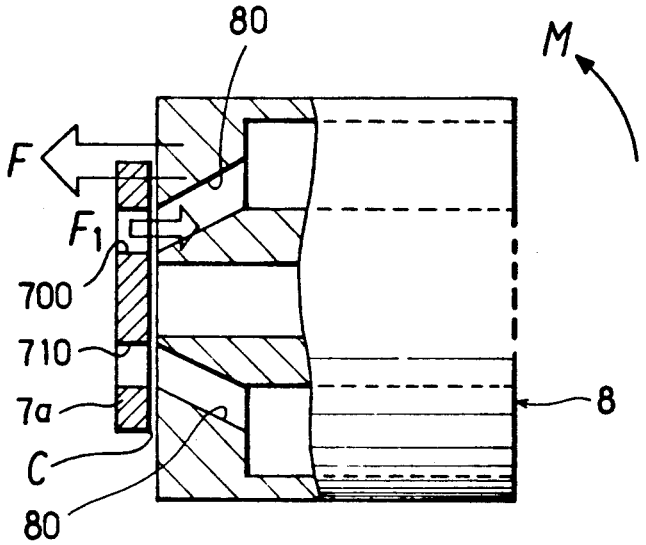
FIG. 5 is a section showing a relation between the cylinder and the valve plate of the conventional axial pump when a pitch circle, on which the intake port and the discharge port are arranged, is simply decreased.
Figure 6:
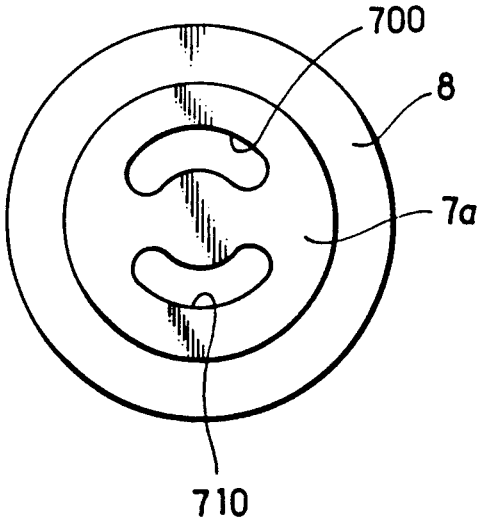
FIG. 6 is a front view of the cylinder block.

Consequently, oil under a high pressure is led to the slanted oil passage 41 and simultaneously is led to the static pressure receiving face 72, pressing the face 72 toward the cover 2*a*. Because the static pressure receiving face 72 is placed near the outer circumference much more than the slanted oil passage 41, the force applied to the static pressure receiving face 72 is appropriately balanced with a reaction force of the valve plate 7. Consequently, a generation of any moment of force as shown in FIG. 5 is prevented and it is possible to generate a suitable liquid membrane on the static pressure receiving face 72 due to an existence of the scallop 77.

As a result, a facial pressure between the cylinder block 4 and the valve plate 7 furthermore decreases, and sliding abrasion and friction resistance between them too decrease, improving a torque efficiency in rotation of the cylinder block 4. Increase of the diameter of the valve plate 7 rises the circumferential speed of the valve plate. Because pressed oil from the oil guide hole 42 functions to separate the valve plate 7 from the cylinder block 4 at the position near the outer periphery of the valve plate 7, as well as pressed oil lubricates between the valve plate 7 and the cylinder block 4, no seizure is happened there.

Oil oozed out from the static pressure receiving face 72 is discharged out of the outer face side from the ring-like low pressure groove 74*a* through the axial hole 75 and the ring-shaped low pressure groove 74*a*, being supplied from the guide hole 21 leading to the ring-like low pressure groove 74*b* to the thrust bearing portion, lubricating the portion. In other aspect, oil oozed out toward the circumference of the cover is collected into the ring-like low pressure groove 73, flows through the scallop 77 reaching the peripheral portion of the valve plate. The oil further flows through the radial groove 76 and is collected in the ring-like low pressure groove 74*b*, being supplied from the guide hole 21 to the thrust bearing portion of the rotary shaft 3. If some oil is oozed or leaked out of the valve plate 7, the oil is supplied from the guide hole 21 to the thrust bearing portion through the ring-like low pressure groove 74*b*.

According to the embodiment shown in FIGS. 7 and 8, the valve plate 7 is integrally formed on the cover 2a, so any pin 9 is not necessary to use and only a few parts is need to employ. In addition, since the valve body is integrally formed on the cover 2a in the second embodiment of the present invention, no leak of oil advantageously from the space between the cover and the valve body differing from the case of the first embodiment having an independent valve plate.

According to the second embodiment of the present invention, oil oozed or leaked from the static pressure bearing face 72 is arrested in the rink-like low pressure groove 74 and supplied from the guide hole 21 to the thrust bearing portion of the rotary shaft 3. What is more, oil oozed out of the outer periphery of the static pressure bearing face 72 flows around the scallop 77 and reaches the circumference of the valve body, flowing through the radial hole 760 and the guide hole 21.

We claim:

1. A pump comprising a cylindrical casing 1; a cylinder block 4 in said casing and having a plurality of cylinder holes 40 arranged along the circumference of said casing so as to extend in the axial direction of said casing, said cylinder block being adapted to rotate together with a rotary shaft 3; a plurality of pistons 5, each slidable received by one of said plurality of cylinder holes so that one end of each piston extends from said cylinder hole, said end being pressed against a slant angle controllable swash plate 6; a cover 2a provided with an intake opening 22 and a discharge opening 23, said cover secured integrally to a portion of said casing on the side remote from said swash plate 6; and a valve plate 7 positioned so as to confront the end face of said cylinder block on the side remote from said swash plate, said valve plate having an intake port 70 and a discharge port 71, each said port being arc-shaped, said ports being arranged symmetrically around a center of said valve plate; wherein said cylinder block has slanted oil passages 41 extending from a bottom corner of each of said cylinder holes to said intake port 70 and said discharge port 71; wherein each of said cylinder holes of said cylinder block has an oil guide hole 42 for leading pressed oil placed in said cylinder hole toward a part of said valve plate positioned on the outer circumference of said casing relative to said intake port and said discharge port, said guide hole being in parallel with said rotary shaft; wherein said valve plate has a face confronting the opening of said oil guide hole of said cylinder block, said valve plate face being a flat static pressure bearing face 72, said valve plate further having ring-like low pressure groove 74 positioned in said valve plate diametrically inward of said static pressure bearing face and outward of said intake port and said discharge port, and wherein said cover 2a has a guide hole 21 providing communication with said ring-like low pressure groove 74 to the thrust bearing zone of said rotary shaft.

2. A pump comprising a cylindrical casing 1; a cylinder block 4 in said casing and having a plurality of cylinder holes 40 arranged along the circumference of said casing so as to extend in the axial direction of said casing, said cylinder block being adapted to rotate together with a rotary shaft 3; a plurality of pistons 5, each slidable received by one of said plurality of cylinder holes so that one end of each piston extends from said cylinder hole, said end being pressed against a slant angle controllable swash plate 6; a cover 2a provided with an intake opening 22 and a discharge opening 23, said cover secured integrally to a portion of said casing on the side remote from said swash plate 6; and a valve plate 7 positioned so as to confront the end face of said cylinder block on the side remote from said swash plate, said valve plate having an intake port 70 and a discharge port 71, each said port being arc-shaped, said ports being arranged symmetrically around a center of said valve plate; wherein said cylinder block has slanted oil passages 41 extending from a bottom corner of each of said cylinder holes to said intake port 70 and said discharge port 71; wherein each of said cylinder holes of said cylinder block has an oil guide hole 42 for leading pressed oil placed in said cylinder hole toward a part of said valve plate positioned on the outer circumference of said casing relative to said intake port and said discharge port, said guide hole being in parallel with said rotary shaft; wherein said valve plate has a face confronting the opening of said oil guide hole of said cylinder block, said valve plate face being a flat static pressure bearing face 72, said valve plate further having ring-like low pressure grooves 74a and 74b, respectively positioned in said valve plate diametrically inward of said static pressure bearing face and outward of said intake port and said discharge port, said ring-like low pressure grooves 74a and 74b communicating with each other through at least one axial-directed hole 75; and wherein said cover 2a has a guide hole 21 providing communicating with said ring-like low pressure groove 74b to the area of the thrust bearing of said rotary shaft.

3. The pump according to claim 2, wherein a ring-like low pressure groove 73 is formed in said valve plate at a position diametrically outward of said static pressure bearing face 72, said ring-like low pressure groove 73 being in communication with said ring-like low pressure groove 74b and a diametric-directed groove 76.

4. The pump according to claim 2, wherein the outer diameter of said valve plate is substantially the same as that of said cylinder block, and wherein said valve plate is independent of said cover and is secured on said cover and prevented from rotating by means of pins.

5. The pump according to claim 2, where said valve plate is formed integrally with an inner face of said cover.

* * * * *